US010837456B2

(12) United States Patent
Kawai et al.

(10) Patent No.: US 10,837,456 B2
(45) Date of Patent: Nov. 17, 2020

(54) VOLUTE PUMP

(71) Applicant: Ebara Corporation, Tokyo (JP)

(72) Inventors: Masahito Kawai, Tokyo (JP); Hiromi Sakacho, Tokyo (JP); Masashi Obuchi, Tokyo (JP); Hiroshi Uchida, Tokyo (JP); Miho Isono, Tokyo (JP); Kenta Tokairin, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 280 days.

(21) Appl. No.: 15/560,790

(22) PCT Filed: Mar. 24, 2016

(86) PCT No.: PCT/JP2016/059379
§ 371 (c)(1),
(2) Date: Sep. 22, 2017

(87) PCT Pub. No.: WO2016/158666
PCT Pub. Date: Oct. 6, 2016

(65) Prior Publication Data

US 2018/0051708 A1 Feb. 22, 2018

(30) Foreign Application Priority Data

Mar. 27, 2015 (JP) ..... 2015-067140

(51) Int. Cl.
*F04D 29/24* (2006.01)
*F04D 29/70* (2006.01)
*F04D 7/04* (2006.01)

(52) U.S. Cl.
CPC ..... *F04D 29/242* (2013.01); *F04D 7/04* (2013.01); *F04D 29/70* (2013.01); *F04D 29/708* (2013.01)

(58) Field of Classification Search
CPC ..... F04D 29/007; F04D 29/406; F04D 29/42; F04D 29/426; F04D 29/4293; F04D 29/708
See application file for complete search history.

(56) References Cited

U.S. PATENT DOCUMENTS

RE14,988 E 11/1920 Parsons
3,447,475 A * 6/1969 Blum ..... F04D 7/045 415/121.1

(Continued)

FOREIGN PATENT DOCUMENTS

CH 63 412 A1 2/1914
CN 1871437 A 11/2006

(Continued)

OTHER PUBLICATIONS

Extended European Search Report issued in European Patent Application No. EP-16 77 2547 dated Oct. 16, 2018.

(Continued)

*Primary Examiner* — Kenneth J Hansen
*Assistant Examiner* — Brian O Peters
(74) *Attorney, Agent, or Firm* — Pearne & Gordon LLP

(57) ABSTRACT

The present invention relates to a volute pump for delivering a liquid containing fibrous substances. The volute pump includes an impeller (1) having a vane (2), and an impeller casing (5) which houses the impeller (1) therein. The impeller casing (5) includes a volute chamber (7), a suction port (3) and a discharge port (4) which communicate with the volute chamber (7), and a tongue portion (10) which forms a starting portion of the volute chamber (7). A groove (18), extending from the suction port (3) to the volute chamber (7), is formed in an inner surface of the impeller casing (5). An intersection point (B), where a terminal end of the vane (2) passes across the groove (18) as viewed from an axial direction of the impeller (1), is located at an opposite side (Continued)

from the tongue portion (10) with respect to a central point of the impeller (1).

7 Claims, 17 Drawing Sheets

(56) References Cited

U.S. PATENT DOCUMENTS

| | | | | |
|---|---|---|---|---|
| 6,139,260 | A | 10/2000 | Arbeus | |
| 6,439,260 | B1 * | 8/2002 | Shuff | E03B 7/12 137/312 |
| 8,109,730 | B2 * | 2/2012 | Andersson | F04D 29/2288 416/180 |
| 9,835,168 | B2 * | 12/2017 | Uchida | F04D 7/04 |
| 9,845,810 | B2 * | 12/2017 | Japikse | F04D 29/664 |
| 9,869,326 | B2 * | 1/2018 | Stark | F04D 7/04 |
| 2012/0121432 | A1 * | 5/2012 | Wakai | F01D 5/048 416/243 |
| 2015/0345505 | A1 * | 12/2015 | Uchida | F04D 29/4286 415/196 |

FOREIGN PATENT DOCUMENTS

| | | | | |
|---|---|---|---|---|
| EP | 1887227 | * | 2/2008 | F04D 29/30 |
| GB | 408159 | A | 4/1934 | |
| JP | S54-67303 | U | 5/1979 | |
| JP | S64-11390 | U | 1/1989 | |
| JP | H11-201087 | A | 7/1999 | |
| JP | 2007-205167 | A | 8/2007 | |
| WO | 2014-086473 | A1 | 6/2014 | |

OTHER PUBLICATIONS

Chinese Office action issued in Chinese Patent Application No. 201680017518.3 dated Nov. 5, 2018.

Japanese Office action issued in Japanese Patent Application No. 2016-059831 dated Jul. 23, 2019.

International Search Report Issued in Patent Application No. PCT/JP2016/059379 dated Jun. 21, 2016.

Written Opinion Issued in Patent Application No. PCT/JP2016/059379 dated Jun. 21, 2016.

* cited by examiner

VOLUTE PUMP

TECHNICAL FIELD

The present invention relates to a volute pump, and more particularly to a volute pump for delivering a liquid containing fibrous substances.

BACKGROUND ART

Conventionally, a volute pump has been used for delivering a liquid, such as sewage water flowing through a sewage pipe. Such sewage water may contain fibrous substances, such as string, or textile. When the fibrous substances are accumulated on a vane of an impeller, the pump may be clogged. Therefore, in order to prevent the fibrous substances from being accumulated on the impeller, there is a volute pump which includes an impeller having sweep-back vane (see Patent document 1).

FIG. 22 is a cross-sectional view showing a volute pump which includes an impeller having sweep-back vanes. As shown in FIG. 22, an impeller 100 includes a plurality of sweep-back vanes 101. The impeller 100 is fixed to a rotational shaft 102, and is housed within an impeller casing 105. The impeller 100 is rotated in a direction of a solid-line arrow, shown in FIG. 22, together with the rotational shaft 102 by an actuator (e.g., electric motor), which is not illustrated. A liquid is discharged in a circumferential direction into a volute chamber 113, which is formed in the impeller casing 105, by the rotation of the impeller 100. The liquid flowing in the volute chamber 113 is discharged through a discharge port 107 to an outside.

The sweep-back vane 101 has a leading edge portion 101*a* which extends helically, and a trailing edge portion 101*b* which extends helically from the leading edge portion 101*a*. The sweep-back vane 101 has a helical shape in which the leading edge portion 101*a* extends from its base-end in a direction opposite to the rotating direction of the impeller 100. Such a configuration can prevent a fibrous substance 109 from being caught on the leading edge portion 101*a*.

The impeller casing 105 is provided with a tongue portion 110 which forms a starting portion of the volute chamber 113. The liquid flowing in the volute chamber 113 is divided by the tongue portion 110, so that most of the liquid flows toward the discharge port 107 and a part of the liquid circulates in the volute chamber 113 (see a dotted line arrow shown in FIG. 22).

FIG. 23 is a view showing the impeller casing 105, which houses the impeller 100 therein, as viewed from a suction port 106, and FIG. 24 is a view showing an inner surface of the impeller casing 105 as viewed from the actuator. In FIG. 24, depiction of the impeller 100 is omitted. As shown in FIG. 23 and FIG. 24, a groove 108, extending helically from the suction port 106 to the volute chamber 113, is formed in the inner surface of the impeller casing 105. This groove 108 is provided for transferring the fibrous substance, which is contained in the liquid, from the suction port 106 to the volute chamber 113 by means of the rotating impeller 100.

CITATION LIST

Patent Literature

Patent document 1: Japanese laid-open utility model publication No. 64-11390

FIGS. 25 through 29 are views each showing a state in which the fibrous substance 109 is transferred to the volute chamber 113 through the groove 108. In FIGS. 25 through 29, the groove 108 is illustrated by a two-dot chain line. As shown in FIG. 25, the fibrous substance 109 contained in the liquid is transferred to an inlet of the groove 108, and is pushed into the groove 108 by the leading edge portion 101*a* of the rotating impeller 100. The fibrous substance 109 is pushed by the trailing edge portion 101*b* of the rotating impeller 100 while being sandwiched between the groove 108 and the trailing edge portion 101*b* of the impeller 100, thereby moving along the groove 108 (see FIGS. 26 through 28). Then, as shown in FIG. 29, the fibrous substance 109 is released into the volute chamber 113.

However, the fibrous substance 109 that has been released into the volute chamber 113 may be caught on the tongue portion 110 having a protruding shape. FIG. 30 is a view showing the fibrous substance 109 that has been caught on the tongue portion 110. As shown in FIG. 30, if fibrous substances 109 are caught repeatedly, the fibrous substances 109 accumulated on the tongue portion 110 come into contact with the impeller 100, thereby inhibiting the rotation of the impeller 100.

SUMMARY OF INVENTION

Technical Problem

The present invention has been made in view of the above circumstance. It is therefore an object of the present invention to provide a volute pump capable of preventing a fibrous substance contained in a liquid from being accumulated on a tongue portion of an impeller casing.

Solution to Problem

In order to achieve the object, according to one aspect of the present invention, there is provided a volute pump comprising: an impeller having a vane; and an impeller casing which houses the impeller therein; wherein the impeller casing includes a volute chamber, a suction port and a discharge port which communicate with the volute chamber, and a tongue portion which forms a starting portion of the volute chamber, wherein a groove, extending from the suction port to the volute chamber, is formed in an inner surface of the impeller casing, and wherein an intersection point, where a terminal end of the vane passes across the groove as viewed from an axial direction of the impeller, is located at an opposite side from the tongue portion with respect to a central point of the impeller.

In a preferred aspect of the present invention, an angle between a reference line connecting the central point of the impeller with the tongue portion and a line segment connecting the central point of the impeller with the intersection point is in a range of 90 degrees to 270 degrees.

In a preferred aspect of the present invention, the angle between the reference line and the line segment is in a range of 135 degrees to 225 degrees.

In a preferred aspect of the present invention, the intersection point is located on an extension line of the reference line.

Advantageous Effects of Invention

According to the present invention, the fibrous substance is released into the volute chamber at a position opposite from the tongue portion. Thereafter, the fibrous substance is transferred in the volute chamber by the flowing liquid which is being subjected to a centrifugal force. In other words, the fibrous substance is transferred in the volute chamber while the fibrous substance is subjected to the centrifugal force generated in a direction away from the tongue portion. Therefore, the fibrous substance is prevented from being caught on the tongue portion.

BRIEF DESCRIPTION OF DRAWINGS

FIG. 19(*b*) is a schematic view showing a state in which the fibrous substance is smoothly transferred toward an outer end of the leading edge portion as the sweep-back vane rotates;

FIG. 19(*c*) is a schematic view showing a state in which the fibrous substance reaches the outer end of the leading edge portion as the sweep-back vane rotates;

DESCRIPTION OF EMBODIMENTS

Figure 1:
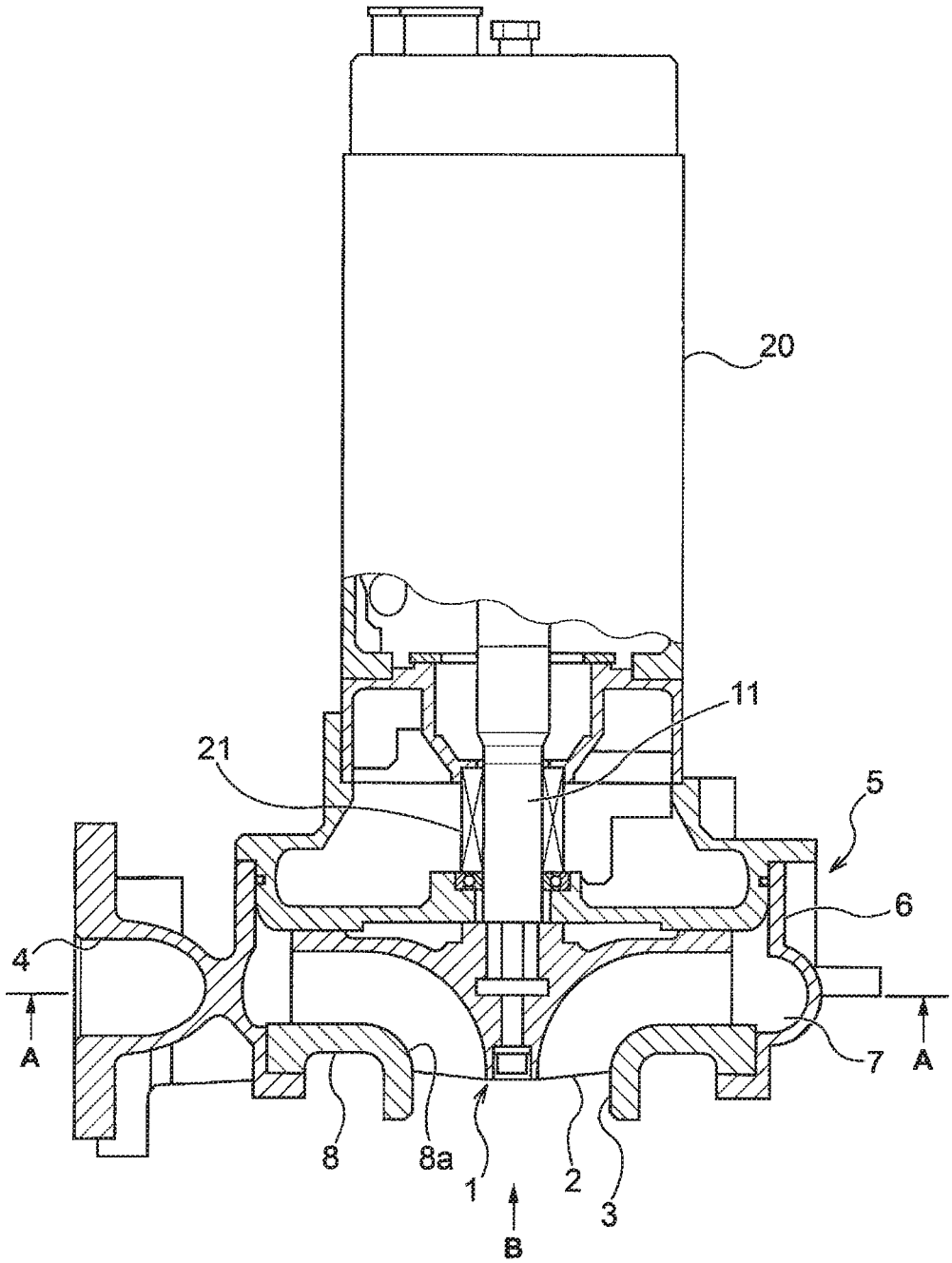
FIG. 1 is a schematic cross-sectional view of a volute pump according to an embodiment of the present invention.

Embodiments of the present invention will be described below with reference to the drawings. The same reference numerals are used in FIGS. 1 through 21 to refer to the same or corresponding elements, and duplicate descriptions thereof will be omitted.

FIG. 1 is a schematic cross-sectional view of a volute pump according to an embodiment of the present invention. The volute pump shown in FIG. 1 is, for example, used for delivering a liquid, such as sewage water flowing through a sewage pipe. As shown in FIG. 1, the volute pump includes an impeller 1 which is fixed to an end of a rotational shaft 11, and an impeller casing 5 which houses the impeller 1 therein. The rotational shaft 11 is rotated by a motor 20, and the impeller 1 is rotated in the impeller casing 5 together with the rotational shaft 11. A mechanical seal 21 is disposed between the motor 20 and the impeller 1. This mechanical seal 21 prevents the liquid from entering the motor 20.

The impeller casing 5 includes a casing body 6 disposed around the impeller 1, and a casing liner 8 coupled to the casing body 6. The casing liner 8 has a cylindrical suction port 3 formed therein. A volute chamber (vortex chamber) 7 is formed inside the casing body 6, and the volute chamber 7 is shaped so as to surround the impeller 1. The casing body 6 has a discharge port 4 formed therein.

When the impeller 1 is rotated, the liquid is sucked from the suction port 3. The rotation of the impeller 1 gives a velocity energy to the liquid, and the velocity energy is converted into a pressure energy when the liquid is flowing through the volute chamber 7, so that the liquid is pressurized. The pressurized liquid is discharged through the discharge port 4. Vanes (sweep-back vanes) 2 of the impeller 1 face an inner surface 8*a* of the casing liner 8 of the impeller casing 5 with a small gap.

Figure 2:
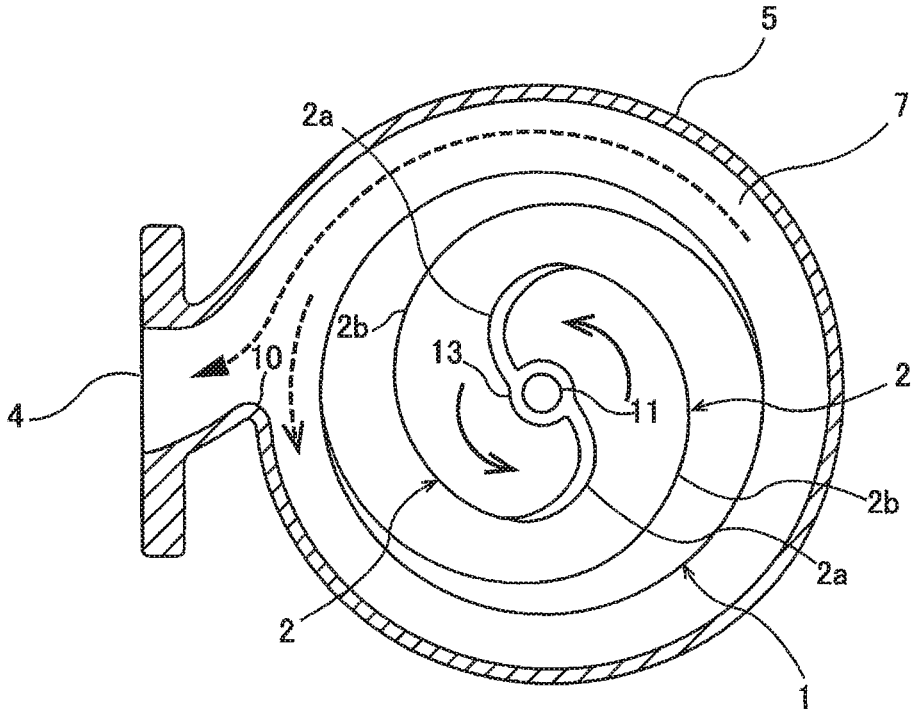
FIG. 2 is a cross-sectional view taken along line A-A in FIG. 1.

FIG. 2 is a cross-sectional view taken along line A-A in FIG. 1. As shown in FIG. 2, the impeller 1 includes a plurality of (two in this embodiment) sweep-back vanes 2, and a cylindrical hub 13. The impeller 1 is fixed to the rotational shaft 11, and is rotated together with the rotational shaft 11 in a direction indicated by a solid line arrow by the motor (actuator) 20. An end of the rotational shaft 11 is inserted into the hub 13, and the impeller 1 is fixed to the end of the rotational shaft 11 by fastening tool (not shown).

The sweep-back vane 2 has a leading edge portion 2*a* which extends helically from the hub 13, and a trailing edge portion 2*b* which extends helically from the leading edge portion 2*a*. The sweep-back vane 2 has a helical shape extending from the hub 13 in a direction opposite to the rotating direction of the impeller 1.

As shown in FIG. 2, the impeller casing 5 is provided with a tongue portion 10 which forms a starting portion of the volute chamber 7. The volute chamber 7 has a shape such that the volute chamber 7 extends along a circumferential direction of the impeller 1 while a cross-sectional area of the volute chamber 7 increases gradually. The liquid flowing in the volute chamber 7 is divided by the tongue portion 10, so that most of the liquid flows toward the discharge port 4 and a part of the liquid circulates through the volute chamber 7 (see a dotted line arrow shown in FIG. 2).

Figure 3:
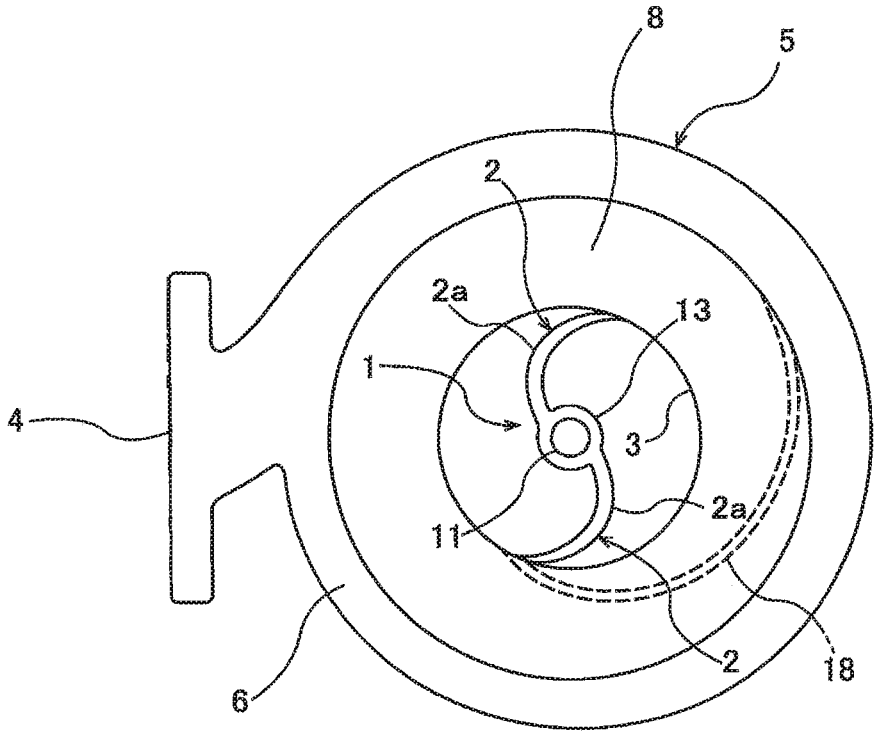
FIG. 3 is a view from a direction indicated by arrow B shown in FIG. 1.

FIG. 3 is a view from a direction indicated by arrow B shown in FIG. 1. As shown in FIG. 3, the impeller casing 5 has the suction port 3 and the discharge port 4 formed therein. The suction port 3 and the discharge port 4 communicate with the volute chamber 7. The suction port 3 is formed in the casing liner 8, and the discharge port 4 is formed in the casing body 6. The liquid which has flowed in from the suction port 3 is discharged to the volute chamber 7 in its circumferential direction by the rotation of the impeller 1. The liquid flowing through the volute chamber 7 is discharged through the discharge port 4 to an outside.

Figure 4:
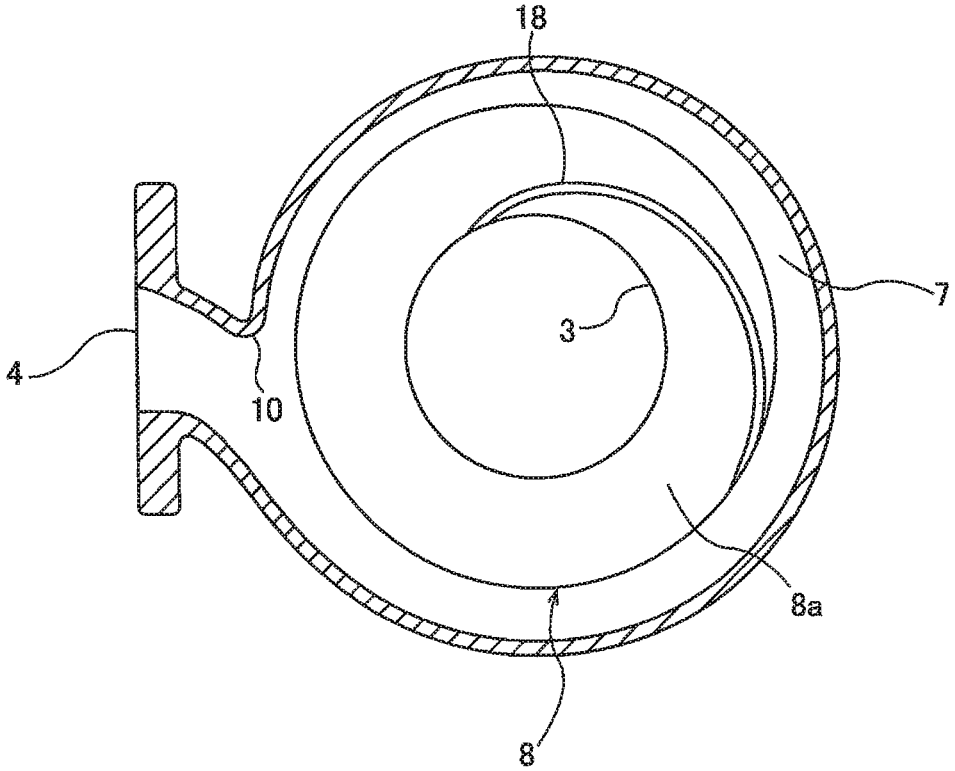
FIG. 4 is a view showing an inner surface of an impeller casing as viewed from a motor.

FIG. 4 is a view showing an inner surface of the impeller casing 5 as viewed from the motor 20. In FIG. 4, depiction of the impeller 1 is omitted. As shown in FIG. 4, a groove 18, extending helically from the suction port 3 to the volute chamber 7, is formed in the inner surface of the impeller casing 5, more specifically in the inner surface 8*a* of the casing liner 8. This groove 18 is provided for transferring a fibrous substance, which is contained in the liquid, from the suction port 3 to the volute chamber 7 by means of the rotating impeller 1. The groove 18 is located so as to face the trailing edge portion 2*b* of the sweep-back vane 2.

Figure 5:
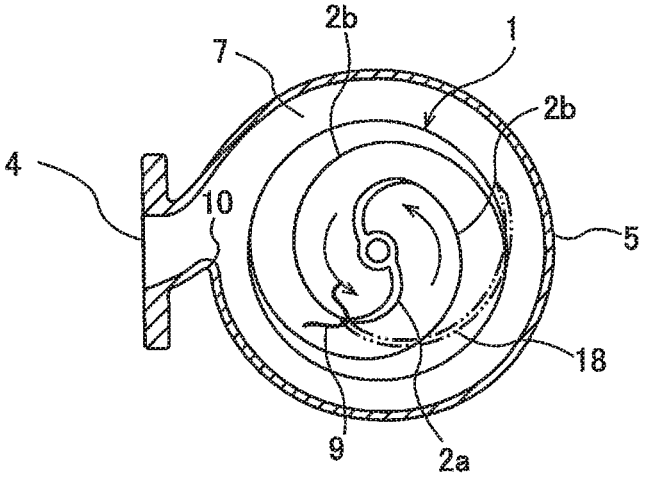
FIG. 5 is a view showing the manner in which a fibrous substance is transferred to a volute chamber through a groove.
Figure 6:
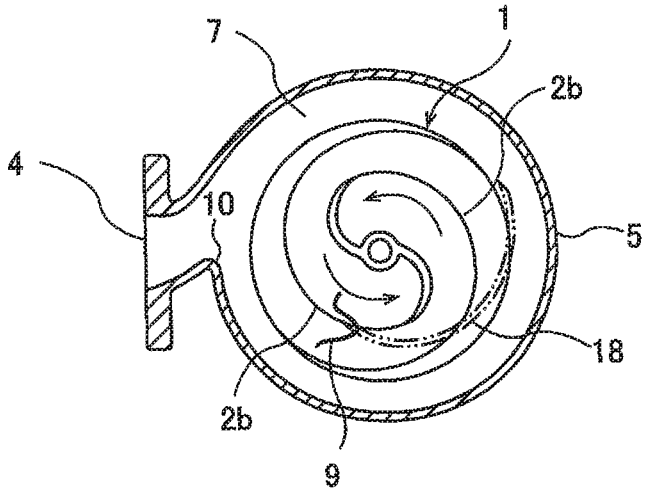
FIG. 6 is a view showing the manner in which the fibrous substance is transferred to the volute chamber through the groove.
Figure 7:
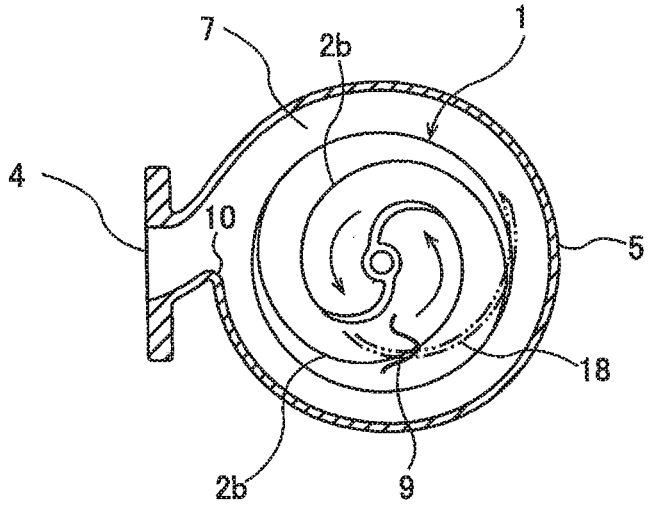
FIG. 7 is a view showing the manner in which the fibrous substance is transferred to the volute chamber through the groove.
Figure 8:
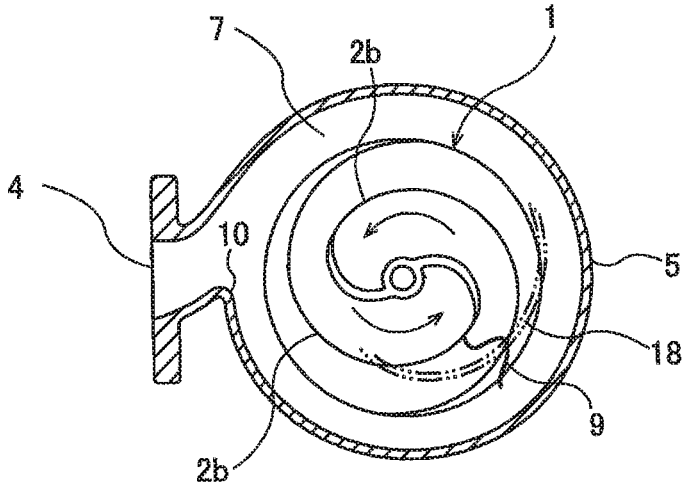
FIG. 8 is a view showing the manner in which the fibrous substance is transferred to the volute chamber through the groove.
Figure 9:
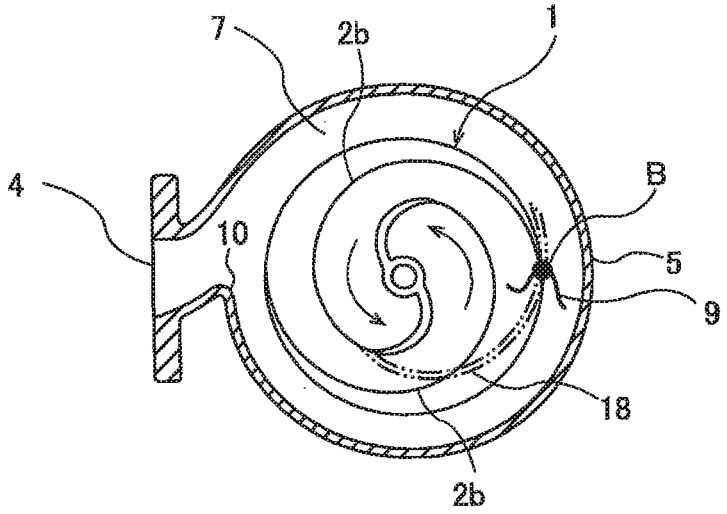
FIG. 9 is a view showing the manner in which the fibrous substance is transferred to the volute chamber through the groove.

FIGS. 5 to 9 are views showing the manner in which a fibrous substance 9 is transferred to the volute chamber 7 through the groove 18. In FIGS. 5 to 9, the groove 18 is illustrated by a two-dot chain line. As shown in FIG. 5, the fibrous substance 9 contained in the liquid is transferred to an inlet of the groove 18 by the leading edge portion 2*a* of the rotating impeller 1, and is pushed into the groove 18 by the leading edge portion 2*a*. The fibrous substance 9 is pushed by the trailing edge portion 2*b* of the rotating impeller 1 while being sandwiched between the groove 18 and the trailing edge portion 2*b* of the impeller 1, thereby moving along the groove 18 (see FIGS. 6 to 8). Then, as shown in FIG. 9, the fibrous substance 9 is released from the groove 18 into the volute chamber 7 at an intersection point B where a terminal end of the sweep-back vane 2 passes across the groove 18 as viewed from an axial direction of the impeller 1. The terminal end of the sweep-back vane 2 is an outer end of the trailing edge portion 2*b*.

Figure 10:
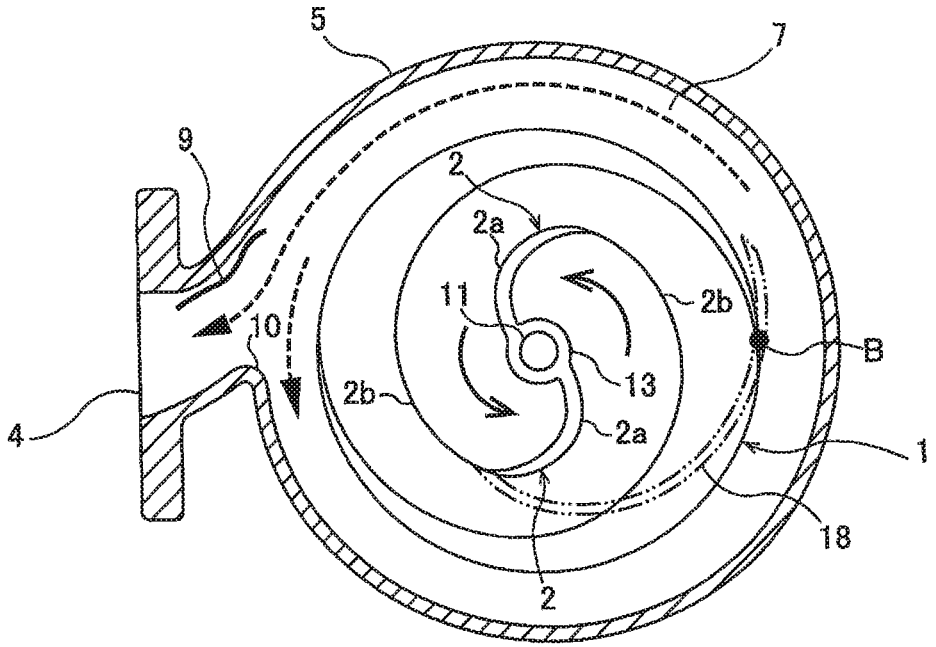
FIG. 10 is a view showing the fibrous substance transferred by the liquid flowing in the volute chamber.

FIG. 10 is a view showing the fibrous substance 9 transferred by the liquid flowing in the volute chamber 7. As shown in FIG. 10, the intersection point B is located at the opposite side from the tongue portion 10 with respect to a central point of the impeller 1. The fibrous substance 9 that has been released into the volute chamber 7 at the intersection point B is transferred in the volute chamber 7 by the flowing liquid which is being subjected to a centrifugal force acting radially outwardly. In other words, the fibrous substance 9 is transferred in the volute chamber 7 while being subjected to the centrifugal force generated in a direction away from the tongue portion 10. Therefore, the fibrous substance 9 is discharged through the discharge port 4 to an outside without being caught on the tongue portion 10.

Figure 11:
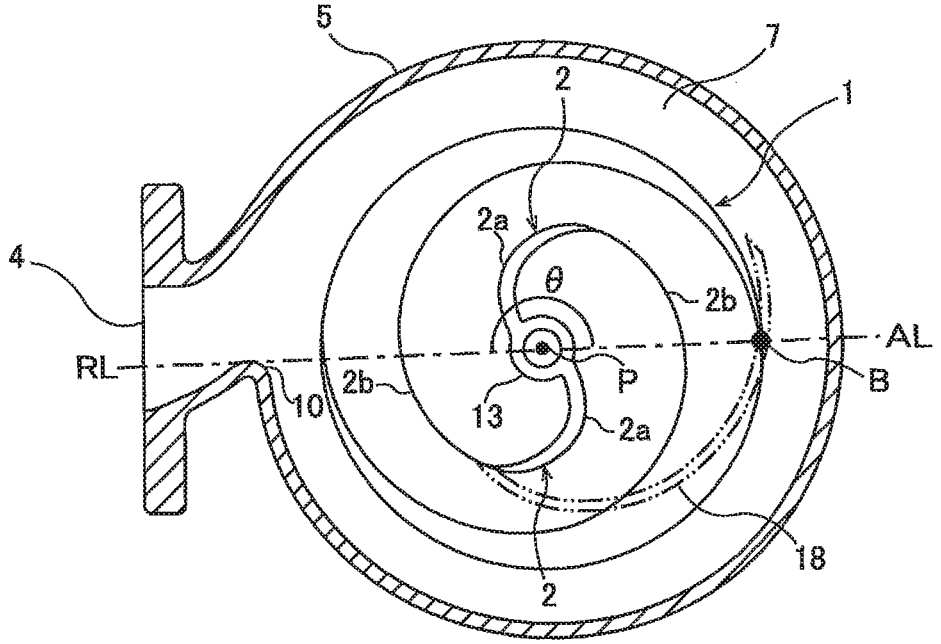
FIG. 11 is a view showing a positional relationship between a tongue portion and the groove.

FIG. 11 is a view showing a positional relationship between the tongue portion 10 and the intersection point B. In FIG. 11, a reference line RL is a line segment connecting a central point P of the impeller 1 with the tongue portion 10 (more specifically, a tip of the tongue portion 10), and an angle line AL is a line segment connecting the central point P of the impeller 1 with the intersection point B. An angle θ represents an angle between the reference line RL and the angle line AL. In this embodiment, the intersection B is located on an extension line of the reference line RL, and the angle θ is 180 degrees. In other words, the intersection point B in this embodiment is located at a position farthest from the tongue portion 10.

With this location of the intersection point B on the extension line of the reference line RL, the fibrous substance 9 is released into the volute chamber 7 at the position farthest from the tongue portion 10. Therefore, even if the fibrous substance 9 flows into the impeller casing 5, the fibrous substance 9 is discharged through the discharge port 4 to the outside without being caught on the tongue portion 10. The angle θ may not be 180 degrees depending on a length of the fibrous substance 9. For example, in a case where a relatively short fibrous substance flows into the impeller casing 5, even if the fibrous substance is released into the volute chamber 7 at a position closer to the tongue portion 10 than the position B shown in FIG. 11, the fibrous substance is discharged through the discharge port 4 to the outside without being caught on the tongue portion 10.

Figure 12:
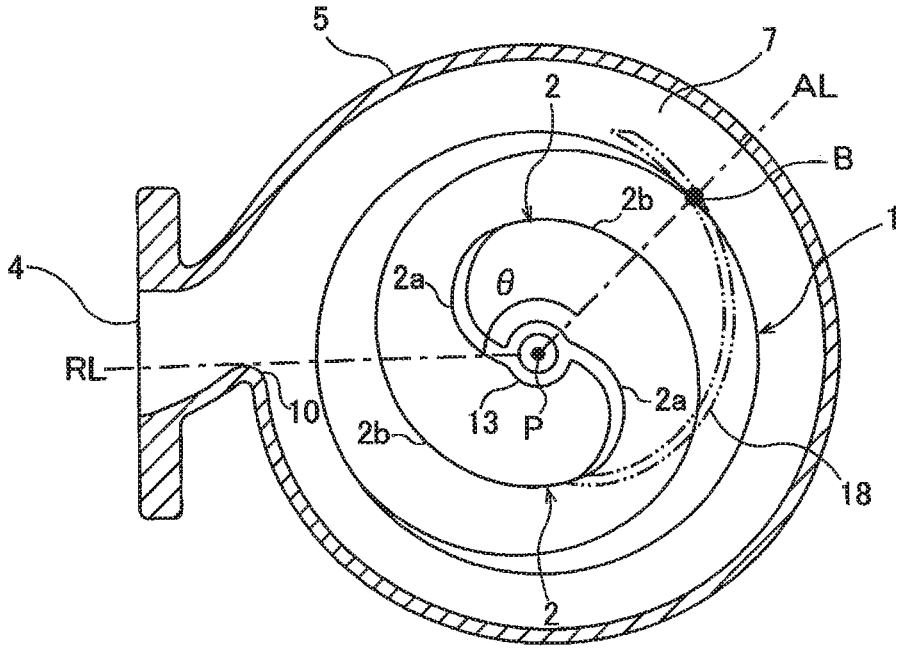
FIG. 12 is a view showing another example of the positional relationship between the tongue portion and the groove.
Figure 13:
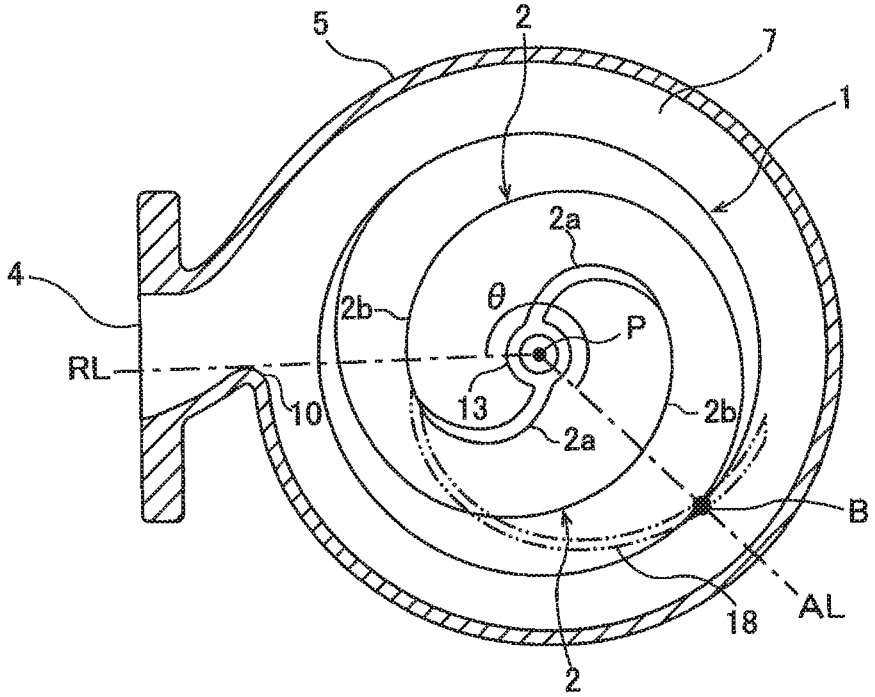
FIG. 13 is a view showing still another example of the positional relationship between the tongue portion and the groove.

FIG. 12 and FIG. 13 are views each showing another arrangement example of the groove 18. In an example shown in FIG. 12, the angle θ is smaller than 180 degrees. In an example shown in FIG. 13, the angle θ is larger than 180 degrees. Also in these examples, each of the intersection point B is located at the opposite side from the tongue portion 10 with respect to the central point of the impeller 1.

The angle θ between the angle line AL and the reference line RL is preferably in the range of 90 degrees to 270 degrees, and more preferably in the range of 135 degrees to 225 degrees. When the angle θ is in this range, the fibrous substance is discharged through the discharge port 4 to the outside without being caught on the tongue portion 10.

Figure 14:
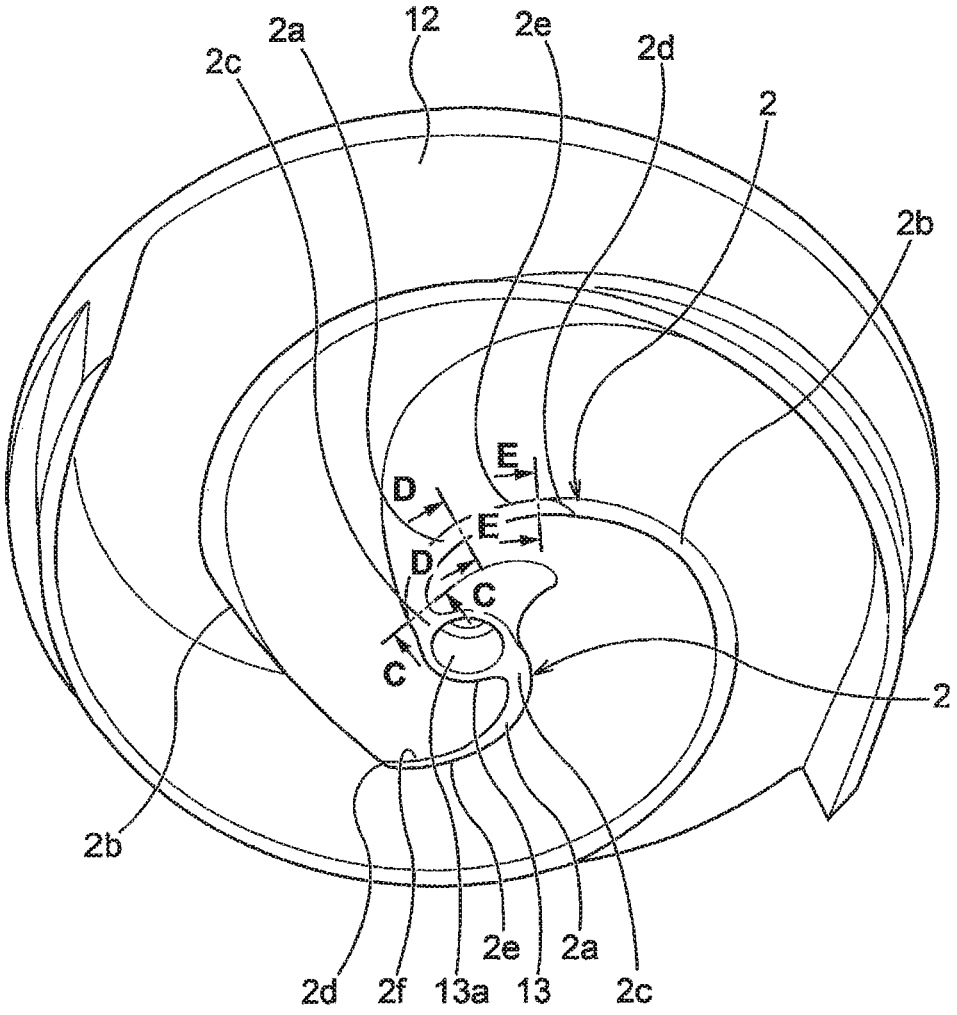
FIG. 14 is a perspective view of the impeller of the volute pump shown in FIG. 1.

FIG. 14 is a perspective view of the impeller 1 of the volute pump shown in FIG. 1. As shown in FIG. 14, the impeller 1 includes a disk-shaped shroud 12 having the hub 13 to which the rotational shaft 11 is fixed, and the sweep-back vanes 2 which extend helically from the hub 13. The hub 13 has a through-hole 13*a* formed therein, into which the end of the rotational shaft 11 is inserted. The entirety of the sweep-back vane 2 has a helical shape which extends from the hub 13 in the direction opposite to the rotating direction of the impeller 1.

Figure 15:
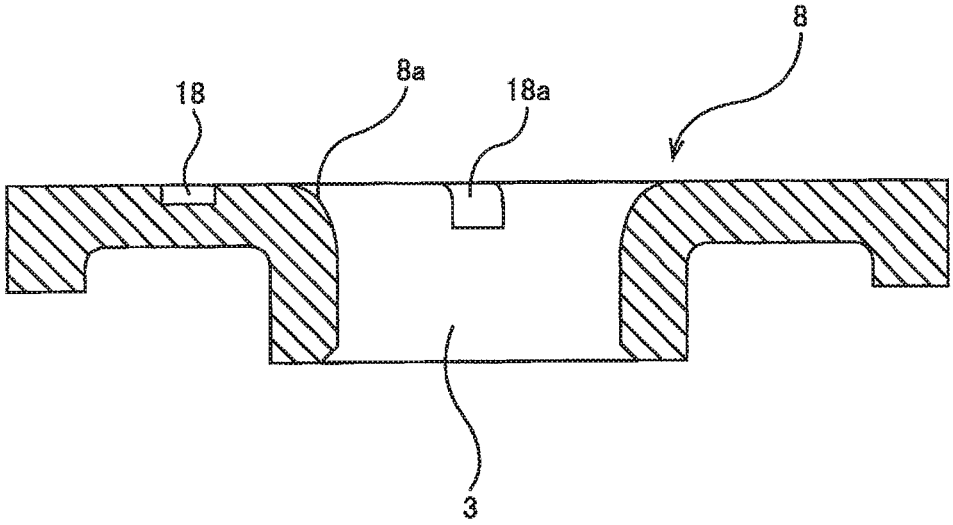
FIG. 15 is a cross-sectional view of a casing liner of the volute pump shown in FIG. 1.

The sweep-back vane 2 has the leading edge portion 2*a* extending helically from the hub 13, and the trailing edge portion 2*b* extending helically from the leading edge portion 2*a*. The leading edge portion 2*a* extends from the hub 13 in the direction opposite to the rotating direction of the impeller 1. Therefore, an outer end 2*d* of the leading edge portion 2*a* is located behind an inner end 2*c* of the leading edge portion 2*a* in the rotating direction of the rotational shaft 11. The trailing edge portion 2*b* faces the inner surface 8*a* of the casing liner 8 with the small gap. When the impeller 1 is rotated, the outer end 2*d* of the leading edge portion 2*a* moves across an inlet 18*a* (see FIG. 15) of the groove 18. FIG. 15 is a cross-sectional view of the casing liner of the volute pump shown in FIG. 1.

Figure 16:
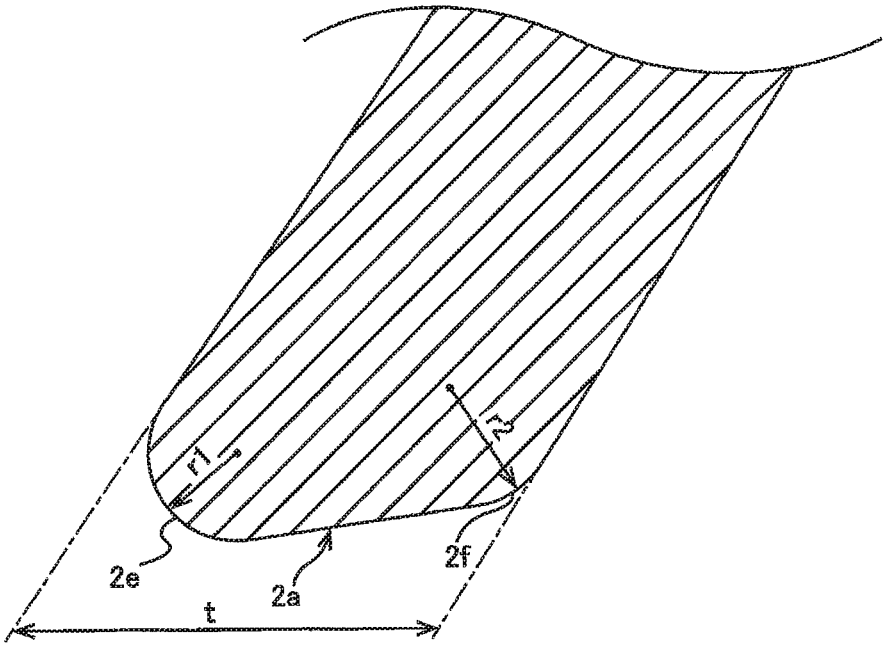
FIG. 16 is a cross-sectional view of a leading edge portion of a sweep-back vane taken along C-C line in FIG. 14.
Figure 17:
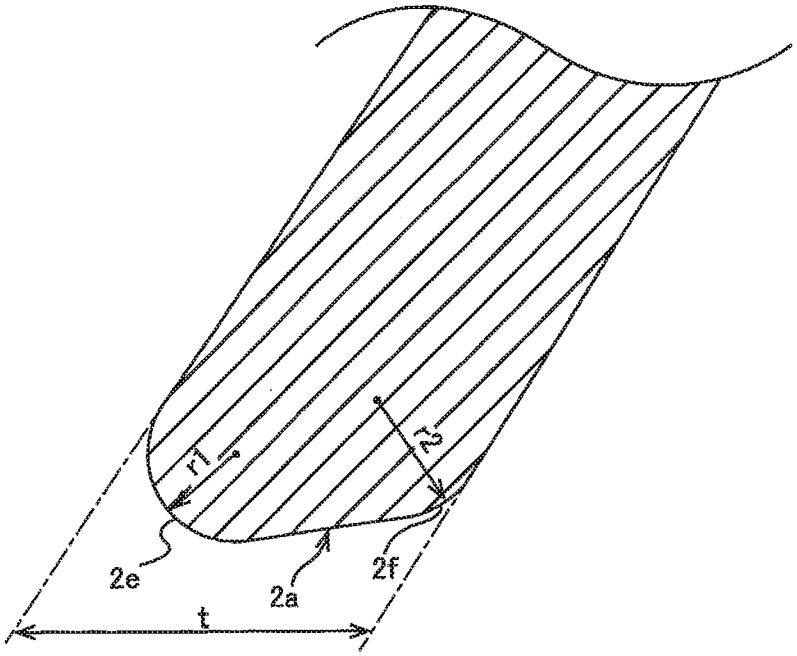
FIG. 17 is a cross-sectional view of the leading edge portion of the sweep-back vane taken along line D-D in FIG. 14.
Figure 18:
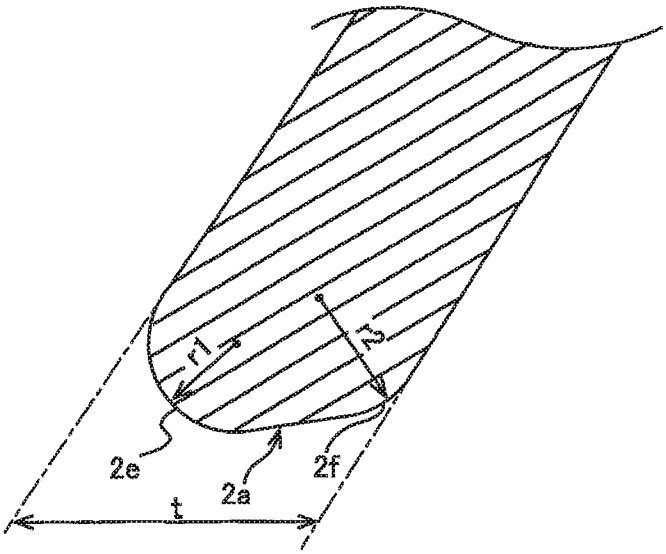
FIG. 18 is a cross-sectional view of the leading edge portion of the sweep-back vane taken along line E-E in FIG. 14.

FIG. 16 is a cross-sectional view of the leading edge portion 2*a* of the sweep-back vane 2 taken along line C-C in FIG. 14. FIG. 17 is a cross-sectional view of the leading edge portion 2*a* of the sweep-back vane 2 taken along line D-D in FIG. 14. FIG. 18 is a cross-sectional view of the leading edge portion 2*a* of the sweep-back vane 2 taken long line E-E in FIG. 14. As shown in FIG. 16, FIG. 17, and FIG. 18, the leading edge portion 2*a* has a front-side curved surface 2*e* extending from the inner end 2*c* to the outer end 2*d* of the leading edge portion 2*a*. The front-side curved surface 2*e* is a forefront of the leading edge portion 2*a*. Specifically, the front-side curved surface 2*e* is a surface of the leading edge portion 2*a* which is located at the foremost position in a rotating direction of the leading edge portion 2*a* (i.e., the rotating direction of the impeller 1), and extends from the inner end 2*c* to the outer end 2*d* of the leading edge portion 2*a*.

A cross-section of the front-side curved surface 2*e* has an arc shape with a radius of curvature r1. In this embodiment, as shown in FIG. 16, FIG. 17, and FIG. 18, the radius of curvature r1 is constant from the inner end 2*c* to the outer end 2*d* of the leading edge portion 2*a*. The radius of curvature r1 of the front-side curved surface 2*e* may vary from the inner end 2*c* to the outer end 2*d* of the leading edge portion 2*a*. For example, the radius of curvature r1 of the front-side curved surface 2*e* may increase or decrease gradually according to a distance from the hub 13.

Figure 19:
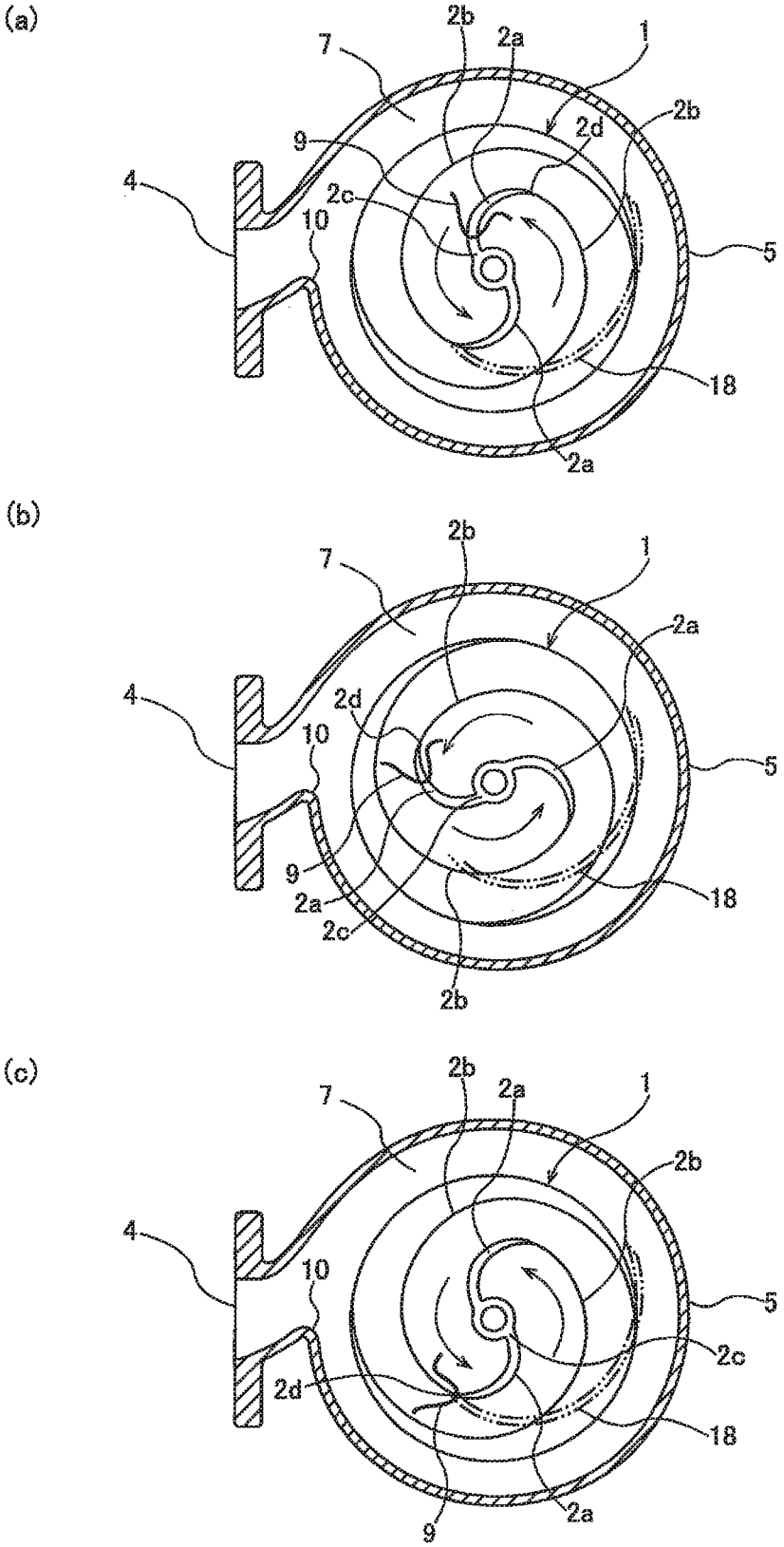
FIG. 19(*a*) is a schematic view showing a state in which the fibrous substance is placed on the leading edge portion of the sweep-back vane.

Since the leading edge portion 2*a* has the front-side curved surface 2*e* extending from the inner end 2*c* to the outer end 2*d* thereof, the fibrous substance 9 that is placed on the leading edge portion 2*a* as shown in FIG. 19(*a*) is smoothly transferred toward the outer end 2*d* of the leading edge portion 2*a* without being caught by the leading edge portion 2*a* as shown in FIG. 19(*b*), and then reaches the outer end 2*d* of the leading edge portion 2*a* as shown in FIG. 19(*c*). Therefore, the leading edge portion 2*a* can smoothly guide the fibrous substance 9 to the inlet 18*a* (see FIG. 15) of the groove 18.

Figure 20:
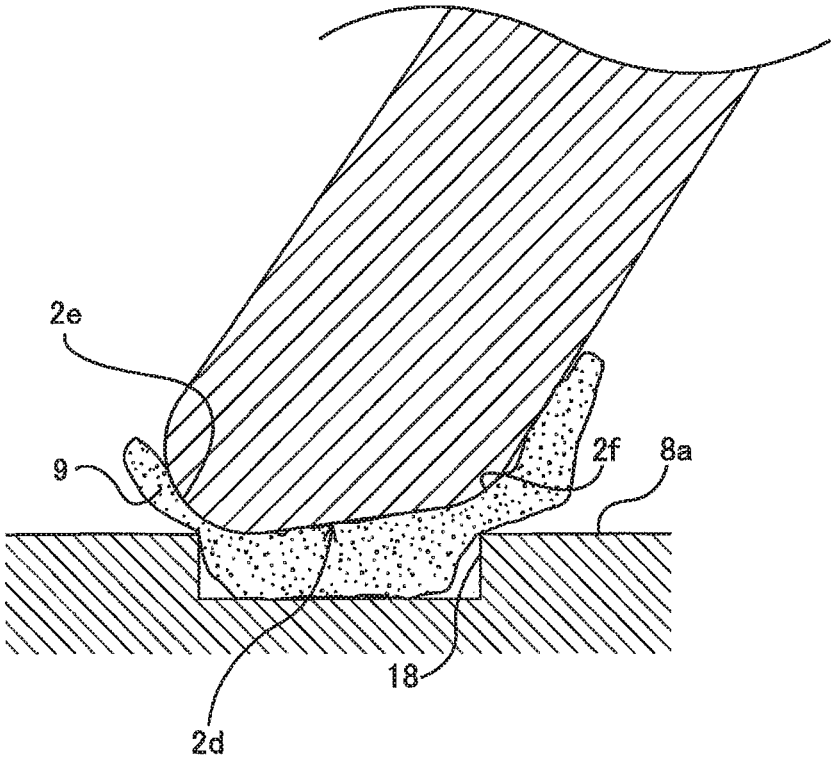
FIG. 20 is a schematic view showing a state in which the fibrous substance that has been guided to the outer end of the leading edge portion is pushed into a groove, formed in the inner surface of the casing liner, by a front-side curved surface of the leading edge portion.

FIG. 20 is a schematic view showing a state in which the fibrous substance 9 guided to the outer end 2*d* of the leading edge portion 2*a* is pushed into the groove 18 by the front-side curved surface 2*e*. As described above, when the impeller 1 is rotated, the outer end 2*d* of the leading edge portion 2*a* of the sweep-back vane 2 passes over the groove 18 (see FIG. 15 and FIG. 4) formed in the inner surface 8*a* of the casing liner 8. As shown in FIG. 20, the fibrous substance 9 guided to the outer end 2*d* is pushed into the groove 18 by the front-side curved surface 2*e*, when the outer end 2*d* passes over the groove 18. Since the front-side curved surface 2*e* extends to the outer end 2*d* of the leading edge portion 2*a*, the fibrous substance 9 is pushed into the groove 18 by the front-side curved surface 2*e* without being caught by the outer end 2*d* of the leading edge portion 2*a*. As a result, the fibrous substance 9 can be reliably transferred into the groove 18.

As shown in FIG. 16, FIG. 17, and FIG. 18, the leading edge portion 2*a* may have a back-side curved surface 2*f* extending from the inner end 2*c* to the outer end 2*d* of the leading edge portion 2*a*. The back-side curved surface 2*f* is a rearmost surface of the leading edge portion 2*a*. Specifically, the back-side curved surface 2*f* is a surface of the leading edge portion 2*a* which is located at the rearmost position in the rotating direction of the leading edge portion 2*a* (i.e., the rotating direction of the impeller 1), and is located behind the front-side curved surface 2*e* in the rotating direction of the impeller 1. As with the front-side curved surface 2*e*, the back-side curved surface 2*f* extends from the inner end 2*c* to the outer end 2*d* of the leading edge portion 2*a*.

A cross-section of the back-side curved surface 2*f* has an arc shape with a radius of curvature r2. In this embodiment, as shown in FIG. 16, FIG. 17, and FIG. 18, the radius of curvature r2 is constant from the inner end 2*c* to the outer end 2*d* of the leading edge portion 2*a*. The radius of curvature r2 of the back-side curved surface 2*f* may be the same as or different from the radius of curvature r1 of the front-side curved surface 2*e*. Further, the radius of curvature r2 of the back-side curved surface 2*f* may vary from the inner end 2*c* to the outer end 2*d* of the leading edge portion 2*a*. For example, the radius of curvature r2 of the back-side curved surface 2*f* may increase or decrease gradually according to a distance from the hub 13.

In a case where the leading edge portion 2*a* has not only the front-side curved surface 2*e* but also the back-side curved surface 2*f*, the fibrous substance 9 can more smoothly slide on the leading edge portion 2*a*. As a result, the leading edge portion 2*a* can smoothly guide the fibrous substance 9 to the outer end 2*d* of the leading edge portion 2*a*. Further, the fibrous substance 9 is hardly caught by the outer end 2*d* of the leading edge portion 2*a*. As a result, the front-side curved surface 2*e* of the leading edge portion 2*a* can more reliably push the fibrous substance 9 into the inlet 18*a* (see FIG. 15) of the groove 18.

As described above, the fibrous substance 9 slides on the front-side curved surface 2*e* toward the outer end 2*d* of the leading edge portion 2*a*, as the impeller 1 rotates. As a ratio (i.e., r1/t) of the radius of curvature r1 of the front-side curved surface 2*e* to a thickness t (see FIG. 16, FIG. 17, and FIG. 18) of the leading edge portion 2*a* becomes smaller, the leading edge portion 2*a* becomes sharper. It has been confirmed that, when r1/t is equal to or more than 1/7, the fibrous substance 9 placed on the leading edge portion 2*a* can be more smoothly guided toward the outer end 2*d* of the leading edge portion 2*a*, and can be more reliably pushed into the groove 18. Therefore, r1/t is preferably equal to or more than 1/7.

As r1/t becomes larger, a discharging performance of the volute pump decreases. The optimal value of r1/t for smoothly sliding the fibrous substance 9 toward the outer end 2*d* of the leading edge portion 2*a* while suppressing the decrease in the discharging performance of the volute pump is 1/4. Therefore, r1/t is more preferably equal to or more than 1/4.

Figure 21:
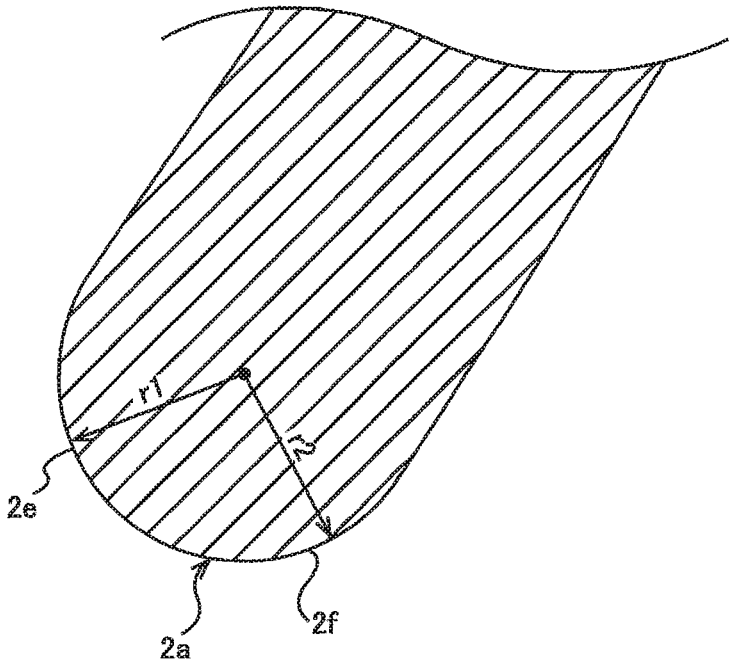
FIG. 21 is a cross-sectional view of the leading edge portion in which a ratio of a radius of curvature of the front-side curved surface to a thickness of the leading edge portion, and a ratio of a radius of curvature of a back-side curved surface to the thickness of the leading edge portion are ½ respectively, and the front-side curved surface is connected with the back-side curved surface.
Figure 22:
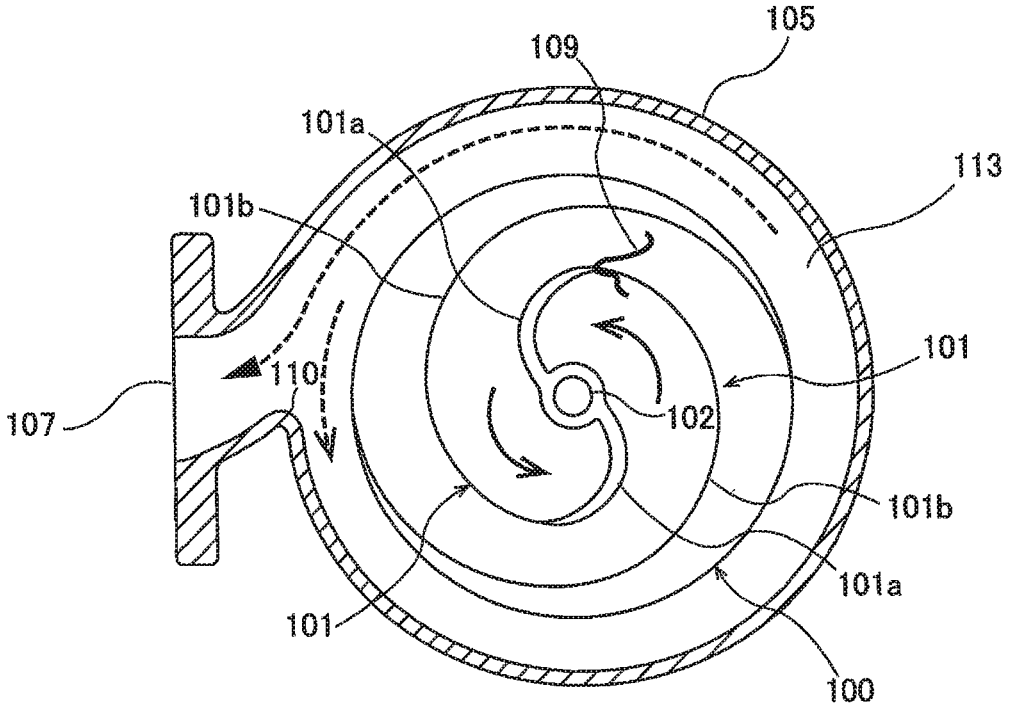
FIG. 22 is a cross-sectional view showing a volute pump which includes an impeller having sweep-back vanes.
Figure 23:
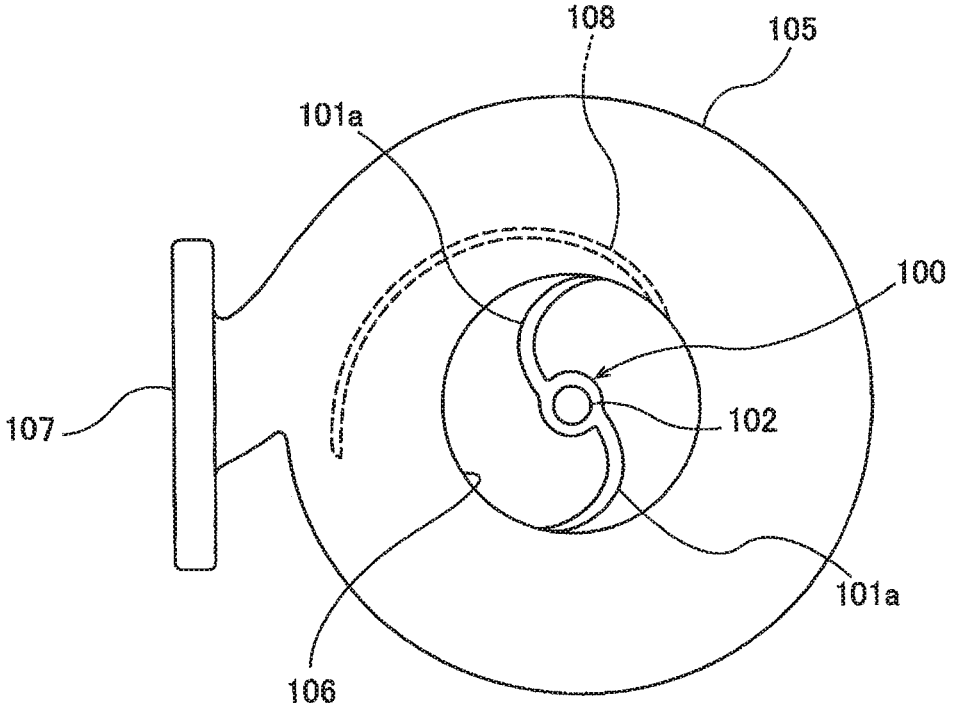
FIG. 23 is a view showing an impeller casing, which houses the impeller therein, as viewed from a suction-port-side.
Figure 24:
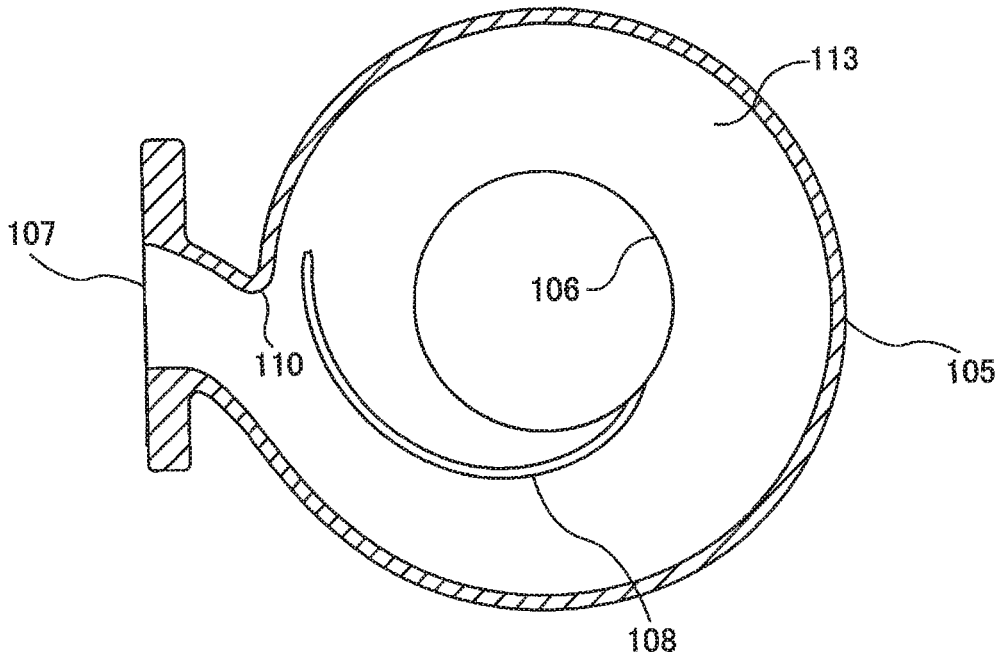
FIG. 24 is a view showing an inner surface of the impeller casing as viewed from an actuator-side.
Figure 25:
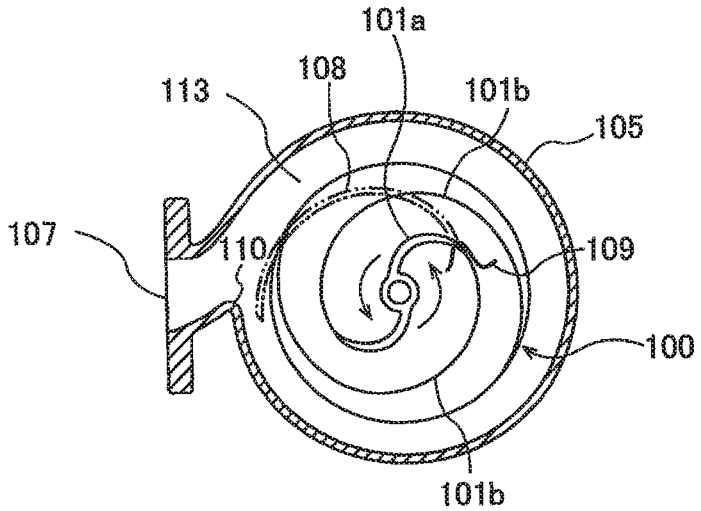
FIG. 25 is a view showing a state in which the fibrous substance is transferred to the volute chamber through a groove.
Figure 26:
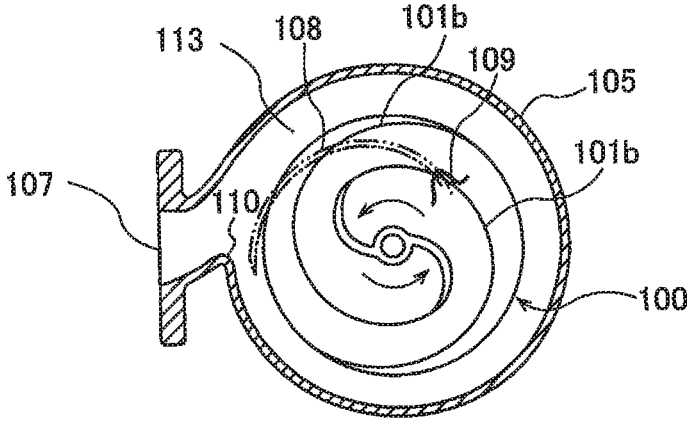
FIG. 26 is a view showing a state in which the fibrous substance is transferred to the volute chamber through the groove.
Figure 27:
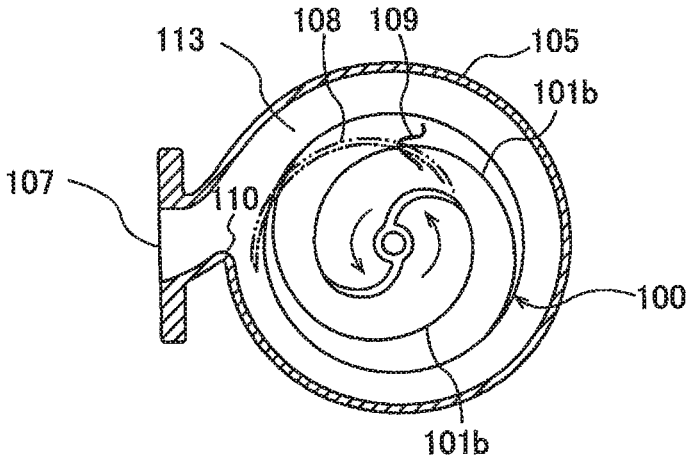
FIG. 27 is a view showing a state in which the fibrous substance is transferred to the volute chamber through the groove.
Figure 28:
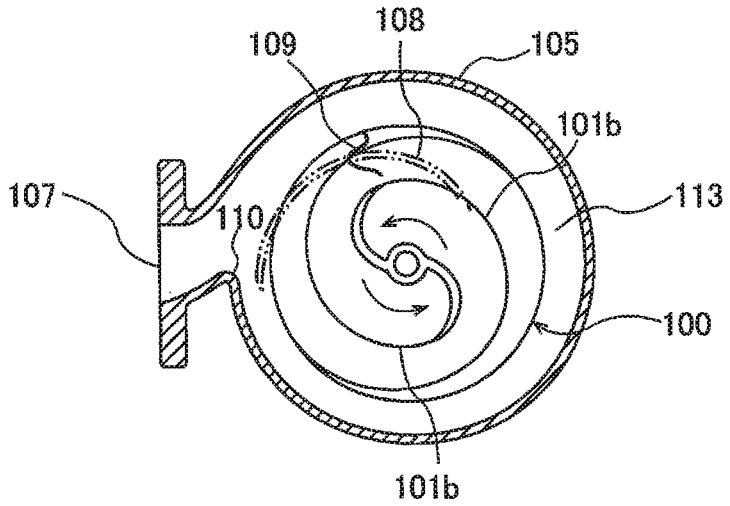
FIG. 28 is a view showing a state in which the fibrous substance is transferred to the volute chamber through the groove.
Figure 29:
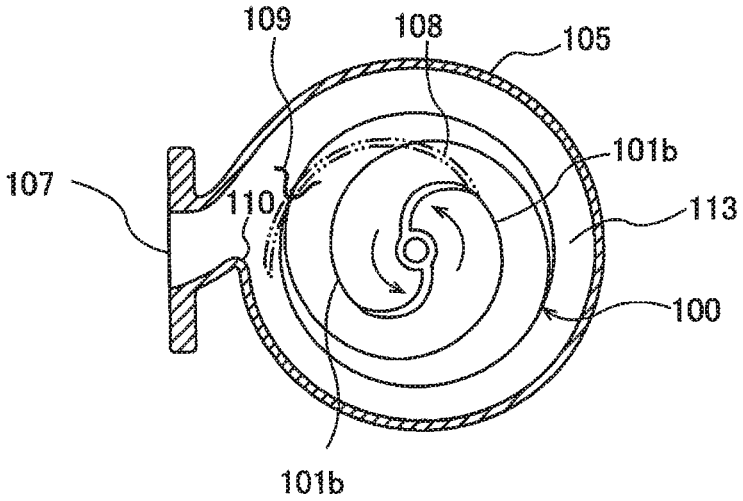
FIG. 29 is a view showing a state in which the fibrous substance is transferred to the volute chamber through the groove.
Figure 30:
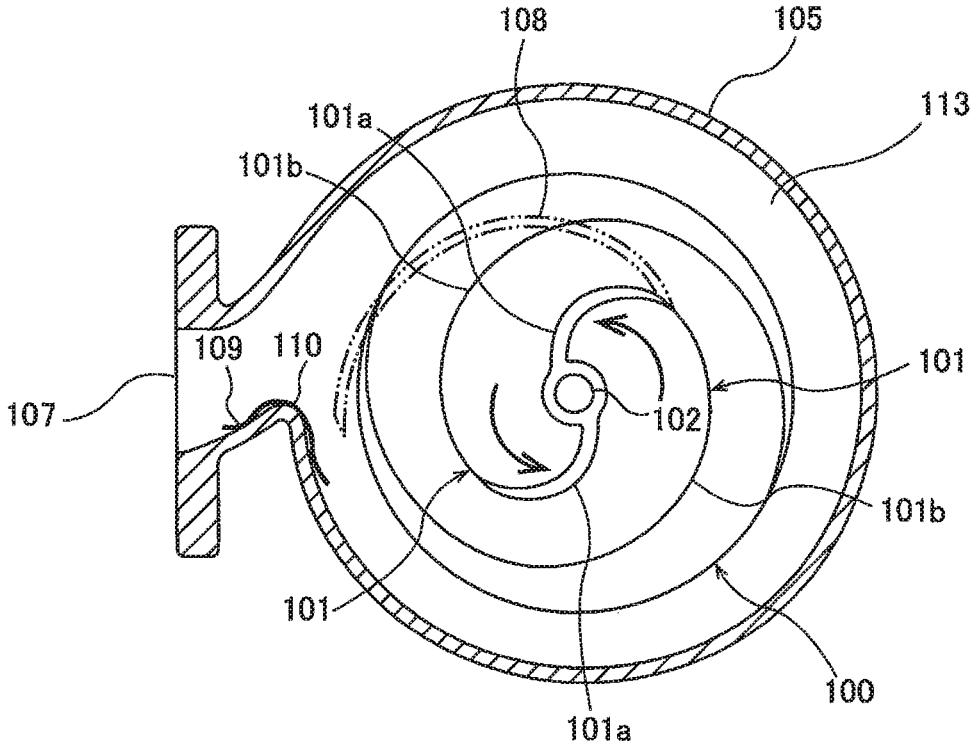
FIG. 30 is a view showing the fibrous substance caught on a tongue portion.

FIG. 21 is a cross-sectional view of the leading edge portion 2*a* in which the ratio (i.e., r1/t) of the radius of curvature r1 of the front-side curved surface 2*e* to the thickness t of the leading edge portion 2*a*, and the ratio (i.e., r2/t) of the radius of curvature r2 of the back-side curved surface 2*f* to the thickness t of the leading edge portion 2*a* are ½, and the front-side curved surface 2*e* is connected with the back-side curved surface 2*f*. As shown in FIG. 21, in a case where r1/t and r2/t are ½, and the front-side curved surface 2*e* is connected with the back-side curved surface 2*f*, the cross-section of the leading edge portion 2*a* has a complete circular arc. In this case, the leading edge portion 2*a* has the most rounded shape, so that the fibrous substance 9 can more smoothly slide on the leading edge portion 2*a* toward the outer end 2*d*. Therefore, r1/t is preferably equal to or less than ½.

As shown in FIG. 16, FIG. 17, and FIG. 18, the thickness t of the leading edge portion 2*a* gradually decreases according to the distance from the hub 13. In contrast, the radius of curvature r1 of the front-side curved surface 2*e* and the radius of curvature r2 of the back-side curved surface 2*f* are constant from the inner end 2*c* to the outer end 2*d* of the leading edge portion 2*a*. Therefore, r1/t and r2/t gradually increase according to the distance from the hub 13. With such configurations, the leading edge portion 2*a* can guide the fibrous substance 9 toward the inlet 18*a* (see FIG. 15) of the groove 18 while suppressing the decrease in the discharging performance of the volute pump.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

INDUSTRIAL APPLICABILITY

The present invention is applicable to a volute pump for delivering a liquid containing fibrous substances.

REFERENCE SIGNS LIST

1, 100 impeller
2, 101 sweep-back vane
2*a*, 101*a* leading edge portion
2*b*, 101*b* trailing edge portion
2*c* inner end
2*d* outer end
2*e* front-side curved surface
2*f* back-side curved surface
3, 106 suction port
4, 107 discharge port
5, 105 impeller casing
6 casing body
7, 113 volute chamber
8 casing liner
9, 109 fibrous substance
10, 110 tongue portion
11, 102 rotational shaft
12 shroud
13 hub
18, 108 groove
20 motor
21 mechanical seal
RL reference line
AL angle line
P central point of impeller

The invention claimed is:

1. A volute pump comprising:
an impeller having a vane; and
an impeller casing which houses the impeller therein;
wherein the impeller casing includes a volute chamber, a suction port and a discharge port which communicate with the volute chamber, and a tongue portion which forms a starting portion of the volute chamber,
wherein the vane has a leading edge portion which extends helically and has an outer end, and a trailing edge portion which extends helically from the leading edge portion,
wherein a groove, extending from the suction port to the volute chamber and located so as to face the trailing edge portion, is formed in an inner surface of the impeller casing,
wherein an intersection point, where a terminal end of the vane passes across the groove as viewed from an axial direction of the impeller, is located at an opposite side from the tongue portion with respect to a central point of the impeller,
wherein the leading edge portion has a front-side curved surface which is located at a foremost position in a rotating direction of the leading edge portion, and the leading edge portion is located at a position where the outer end moves across an inlet of the groove when the impeller is rotated, and
wherein a cross-section of the leading edge portion has two radii connected by a flat surface at an angle configured to guide a substance into the groove.

2. The volute pump according to claim 1, wherein an angle between a reference line connecting the central point of the impeller with the tongue portion and a line segment connecting the central point of the impeller with the intersection point is in a range of 90 degrees to 270 degrees.

3. The volute pump according to claim 2, wherein the angle between the reference line and the line segment is in a range of 135 degrees to 225 degrees.

4. The volute pump according to claim 3, wherein the intersection point is located on an extension line of the reference line.

5. The volute pump according to claim 1, wherein the leading edge portion has a back-side curved surface which is located at a rearmost position in the rotating direction of the leading edge portion.

6. The volute pump according to claim 5, wherein the back-side curved surface extends to the outer end.

7. The volute pump according to claim 1, wherein:
the leading edge portion extends helically from the hub into which an end of a rotational shaft is inserted to which the impeller is fixed, and
the vane has a helical shape extending from the hub in a direction opposite to a rotating direction of the impeller.

* * * * *